United States Patent [19]

Tuck

[11] Patent Number: 4,647,296

[45] Date of Patent: Mar. 3, 1987

[54] SPACERS FOR STRAIGHTENING WARPED PRECIPITATOR CURTAINS

[75] Inventor: Morris B. Tuck, Pascagoula, Miss.

[73] Assignee: Mississippi Power Company, Gulfport, Miss.

[21] Appl. No.: 796,587

[22] Filed: Nov. 8, 1985

[51] Int. Cl.[4] ..... B03C 3/47

[52] U.S. Cl. ..... 55/2; 52/713; 55/145

[58] Field of Search ..... 55/140, 141, 143, 145, 55/154, 2; 52/713, 563

[56] References Cited

U.S. PATENT DOCUMENTS

| | | | |
|---|---|---|---|
| 1,600,496 | 9/1926 | Weiskopf . | |
| 2,380,993 | 8/1945 | Yungman . | |
| 2,535,696 | 12/1950 | Richardson . | |
| 2,875,845 | 3/1959 | Penney . | |
| 3,018,844 | 1/1962 | Gonzalez . | |
| 3,086,341 | 4/1963 | Brandt . | |
| 3,125,426 | 3/1964 | Herber et al. . | |
| 3,158,453 | 11/1964 | Maartman et al. . | |
| 3,277,626 | 10/1966 | Brynjolfsson et al. | 52/713 |
| 3,362,135 | 1/1968 | Steuernagel et al. . | |
| 3,372,529 | 3/1968 | Harms . | |
| 3,490,210 | 1/1970 | Horton et al. . | |
| 3,553,939 | 1/1971 | Dyla . | |
| 3,581,470 | 6/1971 | Aitkenhead et al. . | |
| 3,616,608 | 11/1971 | Steuernagel et al. . | |
| 3,664,092 | 5/1972 | Vincent . | |
| 3,678,653 | 7/1972 | Buschman . | |
| 3,697,039 | 10/1972 | Phelps et al. . | |
| 3,778,970 | 12/1973 | Swimmer et al. . | |
| 3,783,589 | 1/1974 | Ertl et al. . | |
| 3,803,809 | 4/1974 | Gelhaar et al. . | |
| 3,805,496 | 4/1974 | Sokolowski . | |
| 4,007,023 | 2/1977 | Batza et al. . | |
| 4,239,514 | 12/1980 | Junkers . | |
| 4,478,614 | 10/1984 | Jonelis . | |
| 4,479,813 | 10/1984 | Jonelis . | |
| 4,519,818 | 5/1985 | Jonelis . | |
| 4,559,064 | 12/1985 | Ahern | 55/145 |

FOREIGN PATENT DOCUMENTS

| | | |
|---|---|---|
| 1112499 | 8/1961 | Fed. Rep. of Germany . |
| 566171 | 9/1975 | Switzerland . |
| 835012 | 5/1960 | United Kingdom . |
| 1099342 | 1/1968 | United Kingdom . |

OTHER PUBLICATIONS

"The Art of Electrostatic Precipitation" by Jacob Katz, 1979, pp. 86–89.

ACME "Economical Innovative Methods of Straightening Esp Collector Plates so as to Achieve Alignment for the Purposes of Improving Particulate Control & Performance" by Jonelis et al, 1985.

"Getting the Bugs Out of Electrostatic Precipitators", by O. E. Duling, Specialty Conference, 1973, pp. 78–87.

*Power*, "Restore Megawatts Lost to Compliance Deratings", 4–84.

*Primary Examiner*—Kathleen J. Prunner

*Attorney, Agent, or Firm*—Neuman, Williams, Anderson & Olson

[57] ABSTRACT

A spacer is disclosed for being inserted between adjacent curtains of electrostatic precipitators. Each spacer comprises a hanger adapted to engage the top-most edge or support bar of a curtain, for suspending the spacer therefrom, between the adjacent curtains. At least one hanging member or Tuck-bar is adapted to be suspended from the hanger, the number of Tuck-bars being dependent upon the vertical extent of the curtains. Each hanging member has first and second guides for engaging respective opposite stiffening members of adjacent curtains, whereby the hanging member is disposed substantially perpendicular therebetween.

13 Claims, 6 Drawing Figures

Fig-3
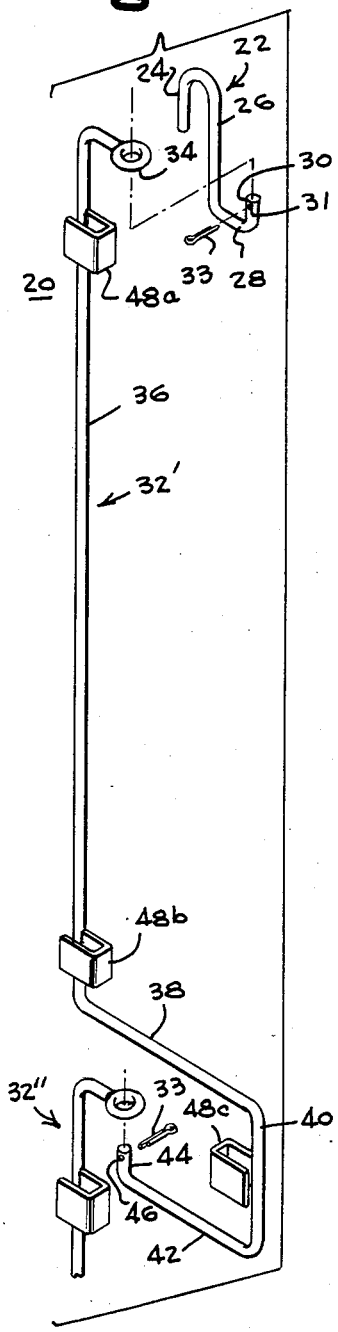
Fig-4
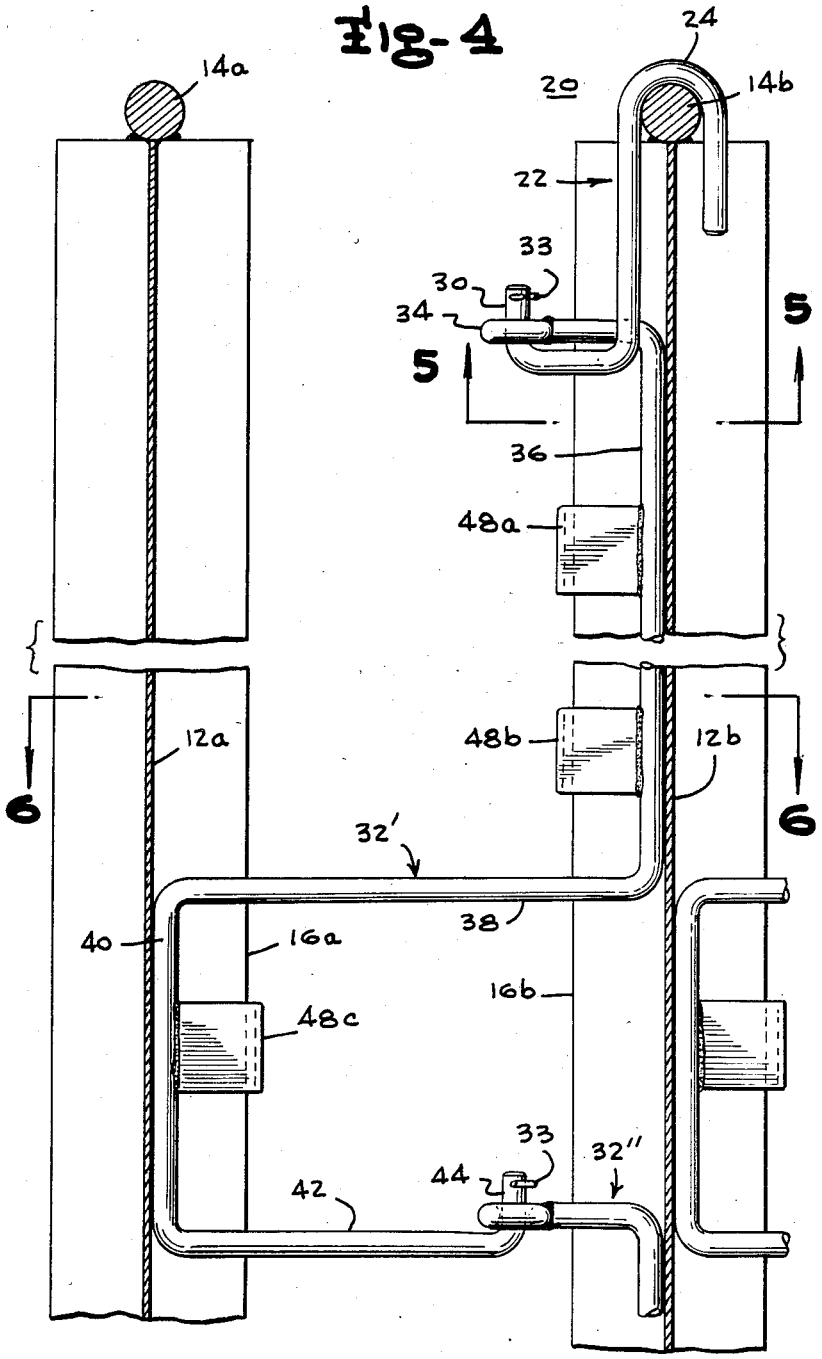
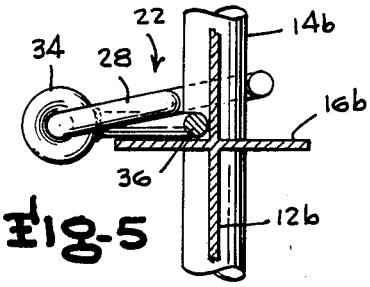
Fig-5
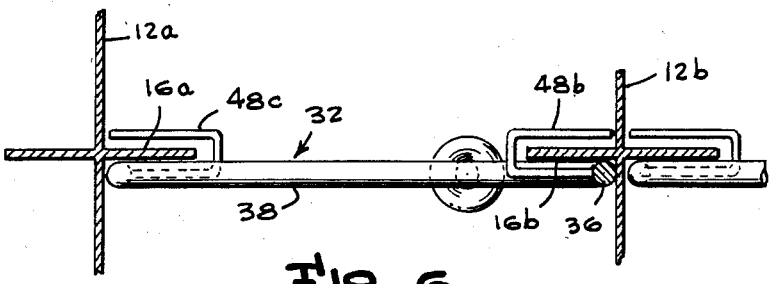
Fig-6

SPACERS FOR STRAIGHTENING WARPED PRECIPITATOR CURTAINS

FIELD OF THE INVENTION

This invention relates to electrostatic precipitators and, more particularly, to spacers disposed between adjacent curtains or electrodes of an electrostatic precipitator to facilitate straightening thereof and maintaining the space therebetween.

BACKGROUND OF THE INVENTION

In an electrostatic precipitator for the recovery of solid particles from a gas stream, it is conventional to configure the collector electrodes as a plurality of generally parallel and preferably upright conductive curtains, which define therebetween generally flat channels or flow paths for the gas stream. Corona-discharge electrodes in the form of wires or the like, may be provided in arrays between the curtains and a dust or particle collecting bin is formed below the curtains. The curtains shed the accumulated dust and solid particles when vibrated by a rapper which provides impact at a rigid member of a structure attached to the electrodes.

In all such electrostatic precipitators, it is important to maintain the planarity of the collector curtains since any distortion may dispose a portion of a collector more closely than is desired and may result in an electrical breakdown across the space between curtain and discharge electrode. Of course to simply avoid the danger that the gap will close to an extent that such breakdown will occur by originally spacing the electrodes apart to a considerable extent, creates the disadvantage that the apparatus becomes less efficient and requires more space for a given volume of gas processed, solids recovered, etc.

Curtains warp due to age and expansion and/or temperature, whereby the efficiency of the electrostatic precipitator is greatly reduced. As the spacing between adjacent electrodes and curtains decreases, the degree of flash discharging therebetween increases and the effectiveness of the precipitator curtains to remove dust and/or soot decreases. The prior art has suggested that spacers be disposed between adjacent electrodes or curtains to prevent the distance therebetween from decreasing.

In the prior art, U.S. Pat. No. 4,007,023 of Batza et al. discloses parallel disposed precipitator electrodes or curtains between which is disposed a plurality of spacers. Spacers are mounted on one curtain and extend toward the other in substantially perpendicular relation thereto. The spacer is dimensioned slightly less than the normal spacing between adjacent curtains so as to provide an air gap between its distal end and the other curtain. A spacer is adapted to pivot up and away from the other precipitator curtain. Batza et al. discloses spacers that are not adapted to be installed upon an existing precipitator curtain and are relatively permanently fixed to the curtains.

In a further solution of the prior art as described in an article entitled "Restore Megawatts Lost to Compliance Deratings", *POWER*, 5/84, spacers in the form of U-shaped members are disposed between adjacent curtains of an electrostatic precipitator. Typically, curtains are conventionally constructed to have evenly spaced and vertically disposed stiffeners or ridges disposed vertically along their length. Such U-shaped members and, in particular, the leg portions of the U-shaped members are disposed in a vertical orientation and are welded to opposing stiffeners of adjacent curtains. Typically, a number of such U-shaped spacers is welded along the vertical extent of adjacent curtains. In order to install such U-shaped members, it is necessary to shut down the operation of the electrostatic precipitator to permit skilled technicians to secure, typically by welding, the spacers between the adjacent curtains.

A further solution takes the form of a ladder-like arrangement comprised of a plurality of sections that are connectable end-on-end to each other. Each section resembles a parallelogram and is comprised of two upright members of substantially equal length, disposed parallel to each other and separated by a pair of pivotally mounted legs, likewise disposed parallel to each other. The legs are pivoted so that the upright members may be disposed adjacent to each other in a collapsed condition, thus permitting the insertion of one section between adjacent curtains. One section may be connected, typically by rivoting, to another to form the spacer arrangement of a length coinciding to the length of the adjacent curtains; the top of one section is connected to the bottom of the next higher section. The topmost section has a pair of hooks which are connected to the upright members and serve to suspend the ladder-like arrangement to the curtain support bars. After insertion, the upright members are separated until the legs are substantially horizontal, whereby the ladder-like arrangement provides a maximum and substantial even spacing between adjacent curtains. Such an arrangement suffers the disadvantage of relatively high weight and expense of construction. Typically, curtains employed in precipitators may extend vertically some 35 ft. in length. A typical section is 3 ft. in length and weighs in the order of 10 lb. Thus, 8 or 9 sections weighing in excess of 75 lbs. must be assembled and lowered between adjacent curtains. Often the personnel assembling and mounting such spacers work in cramped spaces and experience has shown that it is most difficult to lower an assembly of such weight into place between adjacent curtains, while avoiding interference with the corona-discharge electrodes. Once in place, the upright members of such a ladder-like arrangement may be most difficult to separate, especially if there is a number of warpage points along the length of the adjacent curtains. Due to the collapsible nature of such a ladderlike arrangement, care must be taken not to allow one's hands to be caught between the upright members and the legs.

SUMMARY OF THE INVENTION

It is therefore an object of this invention to provide new and improved spacers that are relatively easy to insert quickly between adjacent curtains of an electrostatic precipitator without the necessity of discontinuing normal operation of the precipitator.

It is a further object of this invention to provide new and improved lightweight spacers that may be inserted between adjacent curtains of electrostatic precipitators without the use of special tools by personnel with minimal training.

In accordance with these and other objects of this invention, a spacer is provided for being inserted between adjacent curtains of electrostatic precipitators. Each spacer comprises a hanger adapted to engage the top-most edge or support bar of a curtain, for suspending the spacer therefrom, between the adjacent curtains.

At least one hanging member or Tuck-bar is adapted to be suspended from the hanger, the number of Tuck-bars being dependent upon the vertical extent of the curtains. Each hanging member has first and second guides for engaging respectively the adjacent curtains, whereby the hanging member is disposed substantially perpendicular therebetween.

In an illustrative embodiment of this invention, each hanging member is integrally formed of a first vertically oriented member, and a second horizontally disposed portion connected at one end to the first vertical member and at its other end to a third horizontally oriented member. A mechanism in the form of an eyelet is connected to the top of the first vertical member for suspending the hanging member from the hanger or that hanging member disposed immediately above, and a second mechanism, illustratively in the form of an upright hook, affixed with respect to the third horizontal member.

BRIEF DESCRIPTION OF THE DRAWINGS

While the specification concludes with claims particularly pointing and distinctly claiming the subject matter of the invention, it is believed that the invention will be better understood from the following description taken in conjunction with accompanying drawings, wherein:

FIG. 3 is a perspective view showing in detail the structure of the spacers of this invention and how they are assembled with each other;

FIG. 4 is a side view, partially broken away to illustrate the manner in which the spacers, as shown in FIGS. 2 and 3, are connected to the stiffeners of adjacent curtains;

FIG. 5 is a plan view taken through section 5—5 of FIG. 4; and

FIG. 6 is a plan view taken through section 6—6 of FIG. 4.

DESCRIPTION OF AN ILLUSTRATIVE EMBODIMENT

Figure 1:
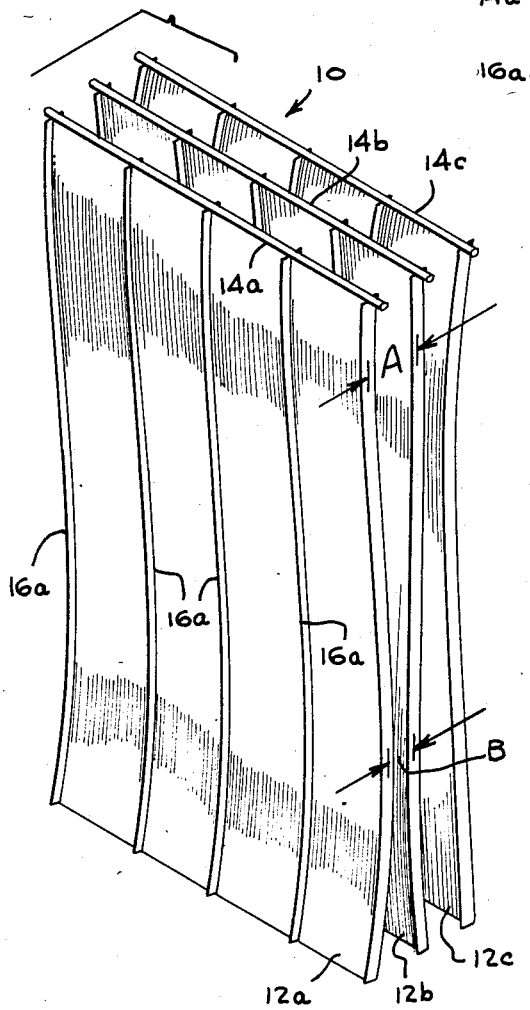
FIG. 1 is a perspective view of warped curtains of an electrostatic precipitator.

Referring now to the drawings and in particular to FIG. 1, there is shown an electrostatic precipitator 10 having a plurality of curtains 12*a*, 12*b* and 12*c*. Each curtain 12 is suspended from its curtain support rod 14. The curtain support rods 14 are disposed substantially parallel with each other with the intent that their curtains 12 will likewise hang in a parallel relation to adjacent curtains. Each curtain 12 has a plurality of equally spaced stiffeners 16 to retard warpage. Though not shown in FIG. 1, it is understood that an array of corona-discharge electrodes is disposed between each of the adjacent curtains 12. Illustratively, such an array includes a support bar from which a plurality, e.g. 8, of wired electrodes is suspended vertically downward between the adjacent curtains.

As discussed above, age, expansion and/or temperature tend to warp the curtains 12, as particularly illustrated in FIG. 1. Unwarped curtains 12 typically have a spacing A between adjacent curtain support rods 14. As warpage occurs, the spacing may shrink to that spacing B. As a result, electrical discharge between adjacent curtains 12*a* and 12*b* and their corona-discharge electrodes (not shown) may occur with the result that the efficiency of the electrostatic precipitator 10 may decrease.

Figure 2:
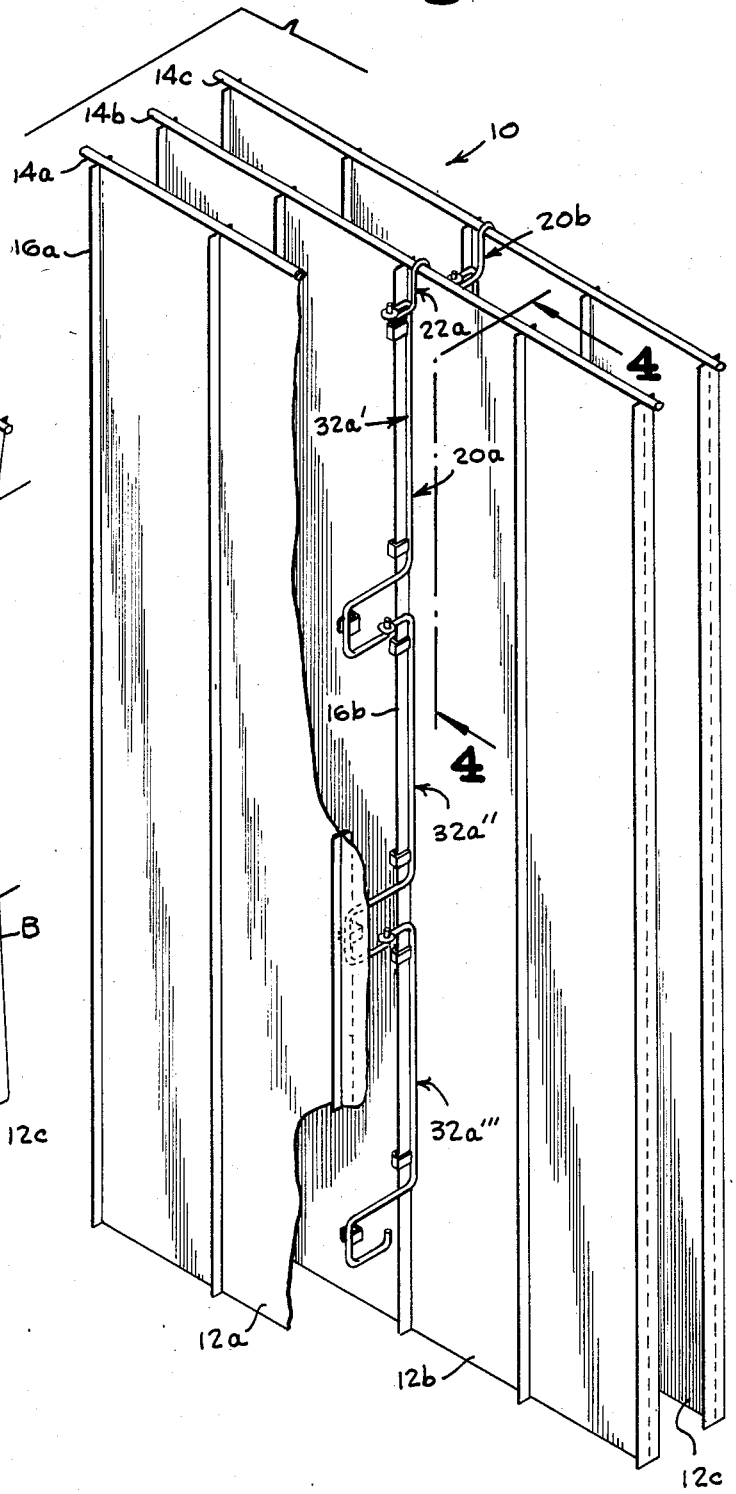
FIG. 2 is a perspective view of an electrostatic precipitator having a plurality of curtains illustrating the manner in which the spacers of this invention may be easily inserted between adjacent curtains of the electrostatic precipitator.

The warpage illustrated in the curtains 12 of FIG. 1 may be straightened and, thereafter, prevented from reoccurring by the insertion of a plurality of spacers 20*a*, 20*b* and 20*c*, in accordance with the teaching of this invention, between adjacent curtains 12, as shown in FIG. 2. Each spacer 20 is comprised of a plurality of Tuck-bars 32 suspended end-to-end from each other. A topmost Tuck-bar 32*a*′ is suspended from the curtain support rod 14*b* of its corresponding curtain 12*b*. As illustrated, a second Tuck-bar 32*a*″ is suspended from the bottommost portion of the first Tuck-bar 32*a*′ and a third Tuck-bar 32*a*‴ is suspended from the bottommost portion of the second Tuck-bar 32*a*″. The Tuck-bars 32 are suspended vertically in series with each other, their number being dependent upon the vertical dimension of the curtains 12. By suspending only the top of a series of the Tuck-bars 32 by a hanger 22 and permitting the last hanging Tuck-bars 32 to remain relatively free with respect to its curtain 12, the spacer 20 remains free to move with respect to its curtains 12 and to provide a spacing therebetween as various influences tend to warp the curtains 12.

In an illustrative embodiment of this invention, the spacer is 42 inches long and eight such spacers 20 are required for a curtain 12 having a vertical dimension of 35 feet. A lesser number of spacers 20 may be used, where the straightening of the lower portion of the curtain 12 is not needed and/or it is desired to reduce cost. As shown in FIG. 2, a single spacer 20*a* is disposed between the curtains 12*a* and 12*b* in an aligned relationship with the centrally disposed stiffener 16*b*. In similar fashion, a second spacer 20*b* is disposed between the curtains 12*b* and 12*c* in alignment with the first spacer 20*a* and engaging the centrally disposed stiffeners 16*b* and 16*c*. Noting that the curtains 12 have illustratively five equally spaced stiffeners, the spacers 20 could be disposed in alignment with the second and fourth stiffeners 16 of adjacent curtains 12. By aligning the spacers 20*a* and 20*b* one behind the other at the center of each curtain 12 as shown in FIG. 2, rigidity is imparted to adjacent curtains 12 and to the entire assembly of curtains 12. Experience has shown that maximum misalignment normally occurs at the center of each curtain 12. Disposing Tuck-bars 32 at the centers of the curtains has proven effective to reduce warpage with a minimum number of Tuck-bars 32 and labor for their installation. However for severely warped curtains 12, it's possible to use 2 or 3 rows of aligned Tuck-bars 32, as would be disposed on either side of the single row of Tuck-bars 32 shown in FIG. 2.

Referring now to FIG. 3, the details of a spacer 20 and its Tuck-bars 32 will be explained. Each spacer 20 includes the hanger 22 which suspends its series of Tuck-bars 32 from a support rod 14 of its curtain 12. Each hanger 22 includes a hook 24 of curved radius greater than the radius of the circumference of the support rod 14, a vertically extending portion 26, a horizontally extending portion 28 and an upright hook 30. As indicated in FIG. 3, the upright hook 30 is designed to fit within an eyelet 34 of the Tuck-bar 32′. A small opening 31 is disposed through the upright hook 30 so that after the upright hook 30 has been disposed within the eyelet 34, a codder pin 33 may be disposed through the hole 31 thus securing the hook 24 and the Tuck-bar 32' together. As will be explained in detail below, the codder pin 33 not only secures the adjacent Tuck-bars 32' and 32'' together, but assists in the installation of the spacer 20 between adjacent curtains 12.

The details of the Tuck-bars 32 will be described with respect to FIGS. 3 and 4. Each Tuck-bar 32 includes its eyelet 34, a first vertically extending portion 36 secured to the eyelet 34 at one end and to a first horizontally extending portion 38 at its other end. A second vertically extending portion 40 is connected at one end to the first horizontal portion 38 and to a second horizontally extending portion 42 at its other end. A hook 44 extends uprightly from the second horizontal portion 42 and is adapted to be disposed within the eyelet 34 of the next lower Tuck-bar 32''. The hook 44 includes a small opening 46 for receiving its codder pin 33. As illustrated in FIGS. 3 and 4, after the upright hook 46 of the first or uppermost Tuck-bar 32' is inserted through the eyelet 34 of the second Tuck-bar 32'' of spacer 20, the codder pin 33 is inserted through its opening 46 and its ends bent to thereby secure the Tuck-bars 32' and 32'' together.

As particularly shown in FIG. 4, each Tuck-bar 32 has a pair of guides **48*a* and 48*b* secured, typically by welding, at the top and bottom of the vertical portion 36. A third guide 48*c* is similarly secured to the second vertical portion 40. As particularly shown in FIG. 6, the guides 48 are U-shaped having a pair of legs and a bite portion; one of the legs of the guide 48*b* is connected to the first vertical portion 36 and is spaced from its other leg by a distance to permit the stiffener 16*b* to loosely fit between the legs of the guide 48*b*. The loose fit between the guides 48 and the stiffeners 16 facilitates the insertion of the Tuck-bars 32 between the curtains 12 and of pushing them down, as will be explained. The loose fit between the guides 48 and the stiffeners 16 prevents any undue binding as may occur when the curtains 12 may warp and, thus, move vertically with respect to the guides 48. In similar fashion, a leg of the guide 48*c* is secured to the second vertical portion 40 and is configured to loosely receive the stiffener 16*a*. The guides 48*a*, 48*b* and 48*c* orient the spacer 20 and, in particular, each of its Tuck-bars 32 to lie in a plane substantially perpendicular to the adjacent curtains 12*a* and 12*b*. By maintaining this relationship of the Tuck-bars 32 to the curtains 12, the spacing between the adjacent curtains 12** is assured.

As shown in FIG. 5, the hanger 22 is askewed with respect to the plane of its curtain 12, whereas the Tuck-bar 32 and, in particular, that portion of the Tuck-bar 32 secured to the eyelet 34 is disposed by the guides 48 in a substantially perpendicular relationship to its curtains 12. To permit such askewing, the radius of the hook 24 must be made slightly greater than the radius of the circular circumference of the support bar 14.

A spacer 20 is inserted between adjacent curtains 12, as shown in FIG. 4. In particular, a first Tuck-bar **32*n'* is first inserted between the curtains 12*a* and 12*b* in a manner to avoid interfering with the corona-discharge electrodes (not shown) disposed therebetween. As seen most clearly in FIG. 3, a Tuck-bar 32 is configured with a relatively long first vertical portion 36 and a relatively short second vertical portion 40. If the U-shaped part comprised of portions 38, 40 and 42 were relatively large, it would be difficult to insert the Tuck-bar 32 between the curtains 12*a* and 12*b*, while avoiding the corona-discharge electrodes. After insertion, the guide 48*c* is aligned with the stiffener 16*a* and inserted therein, before the stiffener 16*b* is inserted within the guides 48*a* and 48*b*. Thereafter, the installer pushes the first inserted Tuck-bar 32*n'* downward until the eyelet 34 is but a short distance from the top of the curtains 12. Then, the next Tuck-bar 32*n*-1' is disposed between the curtains 12*a* and 12*b* and its upright portion 44 disposed through the eyelet 34 and the codder pin 33 inserted through the opening 46 to thereby secure the Tuck-bars 32*n'* and 32*n*-1' together. The uppermost Tuck-bar 32*n*-1' is then pushed downward by the installer, while engaging its guide 48*c* with the straightener 16*a* and its guides 48*a* and 48*b* with the stiffener 16*b*. The codder pin 33 serves to transfer the vertical force exerted upon the topmost Tuck-bar to each of the Tuck-bars connected there below. In this manner, a whole string of Tuck-bars 32 is directed downward between adjacent curtains 12 and warpage is incrementally straightened as the leading or lowermost Tuck-bar 32*n'* is pushed downward. In contrast to a ladder-like arrangement, discussed above, which required a relatively high exertion force to remove warpage along the entire length of the curtains, the spacer 20 only removes a relatively small portion of the warpage at any one time, thus reducing the amount of force needed to push the string of Tuck-bars 32** downwardly.

Thus, there has been shown a new and improved spacer and method of insertion of such spacers between adjacent curtains of an electrostatic precipitator. The insertion of the spacers in accordance with the teachings of this invention does not require any particular expertise or the use of any special tools, and may be accomplished quickly without requiring a long shutdown of the electrostatic precipitator. Each spacer is comprised of a hanger resting on the top of its curtain and a plurality of Tuck-bars serially connected end-on-end in a serial relationship to each other. The use of a plurality of such Tuck-bars permit the assembly of the spacer without disassembling the curtains and permits the use of this spacer for curtains of varying vertical dimension.

In considering this invention, it should be remembered that the present disclosure is illustrative only and the scope of the invention should be determined solely by the appended claims.

I claim as my invention:

1. In an electrostatic precipitator having adjacent first and second curtains, the improvement comprising a spacer inserted between said first and second curtains to effect straightening of said curtains when warped and, thereafter, to prevent further curtain warpage, each curtain having a top edge and being disposed substantially parallel with the adjacent curtain, said spacer comprising:

(a) a hanger comprising first suspending means secured at one end to engage and to suspend said hanger from the top edge of the first curtain, and second suspending means spaced from said first suspending means; and (b) at least one hanging member having third suspending means for engaging said second suspending means and suspending said hanging member from and below said hanger, and first and second guide means for engaging respectively the first and second curtains to orient said hanging member substantially perpendicular to each of the first and second curtains and to facilitate relatively free movement between the first and second guide means and the first and second curtains.

2. The precipitator as claimed in claim 1 wherein each said curtain has at least one stiffening member extending therefrom, wherein said first and second guide means engage said stiffening members.

3. The precipitator as claimed in claim 2, wherein said each of said first and second guide means comprises a U-shaped member having a pair of legs, and a bite portion disposed therebetween, said legs being spaced from each other a distance to permit said guide means to receive one of said stiffening members therebetween.

4. The precipitator as claimed in claim 1, wherein there is included a plurality of said hanging members vertically aligned.

5. The precipitator as claimed in claim 4, wherein each of said hanging members includes fourth suspending means spaced from said third suspending means for engaging said third suspending means of that hanging member disposed immediately there below and for suspending that hanging member therefrom.

6. The precipitator as claimed in claim 1, wherein said hanging member comprises a first vertically oriented portion extending along the first curtain, and a second vertically oriented portion extending along the second curtain, and means disposed between and interconnecting said first and second vertical portions, whereby the first and second curtains are spaced apart a given distance.

7. The precipitator as claimed in claim 6, wherein there is included a plurality of said hanging members, and each of said hanging members includes a horizontal extending portion connected to said second vertical portion and fourth suspending means affixed to said horizontal portion to dispose said fourth suspending means adjacent the first curtain.

8. The precipitator as claimed in claim 6, wherein said first and second guide means are affixed to said first and second vertical portions, respectively.

9. The precipitator as claimed in claim 8 wherein each of the first and second curtains includes stiffening members extending therefrom, wherein each of said first and second guide means is U-shaped and includes a pair of legs and a bite portion disposed therebetween, said legs spaced apart a sufficient distance to receive therebetween one of said stiffening members.

10. The precipitator as claimed in claim 1, wherein there is included a plurality of hanging members suspended in series and end-to-end relationship, each of said hanging members comprising a first vertically oriented member extending along the first curtain and affixed integrally to said third suspending means, a second horizontally oriented member affixed integrally to and oriented substantially perpendicular to said first vertical member, a third vertically oriented member extending along the second curtain and affixed to and disposed substantially perpendicular to said second horizontal member, and a fourth member oriented horizontally and affixed to and disposed substantially perpendicular to said third vertical member, and fourth suspending means affixed to said fourth horizontal member for engaging said third suspending means of the immediately lower hanging member and for suspending that hanging member therefrom, said first and second guides affixed to said first and third vertical members respectively.

11. A method of installing a spacer between adjacent first and second curtains of an electrostatic precipitator to effect a gradual straightening of any warpage therein, the spacer comprising a hanger with first suspending means secured to one end to engage and to suspend the hanger from a top edge of the first curtain and second suspending means spaced from said first suspending means, and a selected number of vertically aligned hanging members, each hanging member having spaced apart third and fourth suspending means, said third suspending means engaging said second suspending means of said hanger or said fourth suspending means of that hanging member disposed immediately above and suspending said hanging member from below the hanger or the above hanging member, said method comprising the steps of:

(a) placing the first of the selected number of hanging members between the first and second curtains and disposing the first hanging member downwardly; and (b) connecting the third suspending means of the first hanging member to the fourth suspending means of the next above hanging member and, thereafter, disposing the first and second hanging members downward together.

12. The method as claimed in claimed 11, further including the repeating of steps (a) and (b) until a sufficient number of hanging members have been inserted between the first and second curtain to straighten any warpage therein.

13. The method as claimed in claim 12, further including the step of suspending said hanger at one end to engage and to suspend the hanger from the top of the first curtain and connecting the second suspending means of the hanger with the third suspending means of the hanging member disposed immediately there below.

* * * * *